US007839352B2

(12) United States Patent
Strauser et al.

(10) Patent No.: US 7,839,352 B2
(45) Date of Patent: Nov. 23, 2010

(54) WASH DESTRUCTIBLE RESONANT TAG

(75) Inventors: Seth Strauser, Sewell, NJ (US); Charles Iacono, Mount Laurel, NJ (US)

(73) Assignee: Checkpoint Systems, Inc., Thorofare, NJ (US)

( * ) Notice: Subject to any disclaimer, the term of this patent is extended or adjusted under 35 U.S.C. 154(b) by 66 days.

(21) Appl. No.: 12/193,959

(22) Filed: Aug. 19, 2008

(65) Prior Publication Data

US 2009/0058757 A1 Mar. 5, 2009

Related U.S. Application Data

(60) Provisional application No. 60/968,713, filed on Aug. 29, 2007.

(51) Int. Cl.
*H01Q 1/36* (2006.01)

(52) U.S. Cl. ..... 343/895; 343/700 MS; 340/572.1

(58) Field of Classification Search ..... 343/895, 343/700 MS, 702; 340/572, 572.1, 693
See application file for complete search history.

(56) References Cited

U.S. PATENT DOCUMENTS 5,108,822 A * 4/1992 Imaichi et al. ..... 428/209
5,119,070 A * 6/1992 Matsumoto et al. ..... 340/572.5
5,574,431 A 11/1996 McKeown et al.
5,589,251 A * 12/1996 Imaichi et al. ..... 428/209
5,695,860 A * 12/1997 Imaichi et al. ..... 428/209
6,091,607 A 7/2000 McKeown et al.
6,313,747 B2 11/2001 Imaichi et al.
2007/0096915 A1 5/2007 Forster et al.
2007/0159353 A1 * 7/2007 Arai et al. ..... 340/870.11

FOREIGN PATENT DOCUMENTS

JP 2001/167366 6/2001
JP 02007219575 * 8/2007
WO 9945513 9/1999
WO 2006048663 A1 5/2006
WO 2006077391 A1 7/2006

OTHER PUBLICATIONS

International Search Report for PCT/US2008/074037 mailed Nov. 25, 2008.

* cited by examiner

*Primary Examiner*—HoangAnh T Le
(74) *Attorney, Agent, or Firm*—Caesar, Rivise, Bernstein, Cohen & Pokotilow, Ltd.

(57) ABSTRACT

A resonant tag for use with a radio-wave detection system for the prevention of shoplifting or the like, which has a coil and capacitor circuit formed on opposite sides of an extremely thin substrate of a biaxially-oriented polypropylene, with one of the capacitor plates formed on one side of the substrate and the coil and other capacitor plate formed on the other side of the substrate, and paper layers on both sides of the tag, whereby the circuit is destroyed when the tag is washed in water or dry cleaned.

18 Claims, 7 Drawing Sheets

FIG.3
(PRIOR ART)
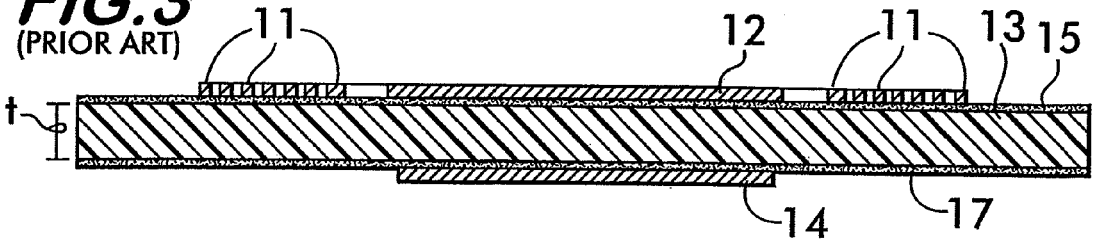
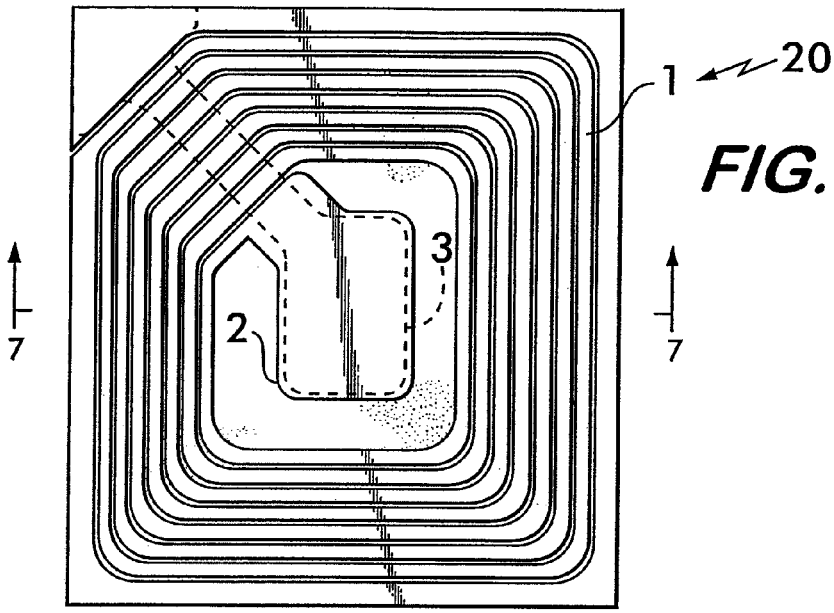
FIG.4
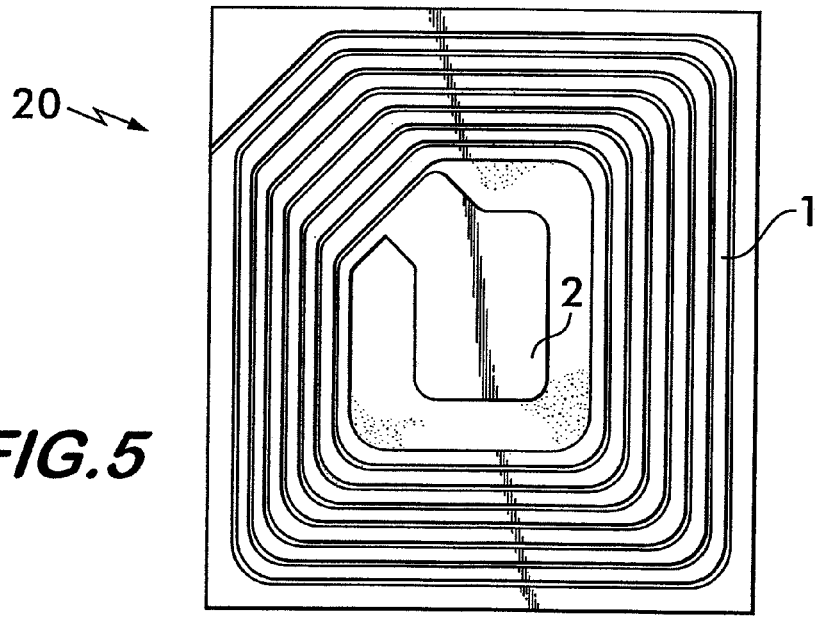
FIG.5

FIG.10
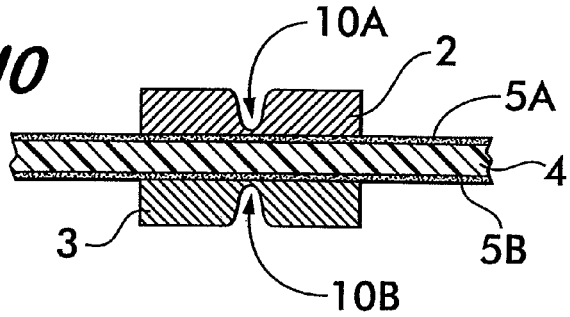
FIG.11A
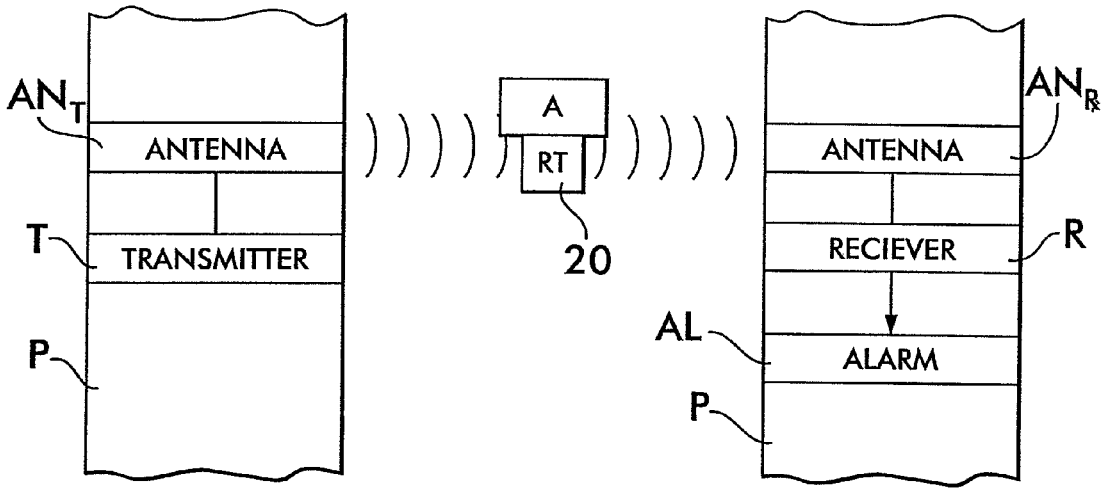
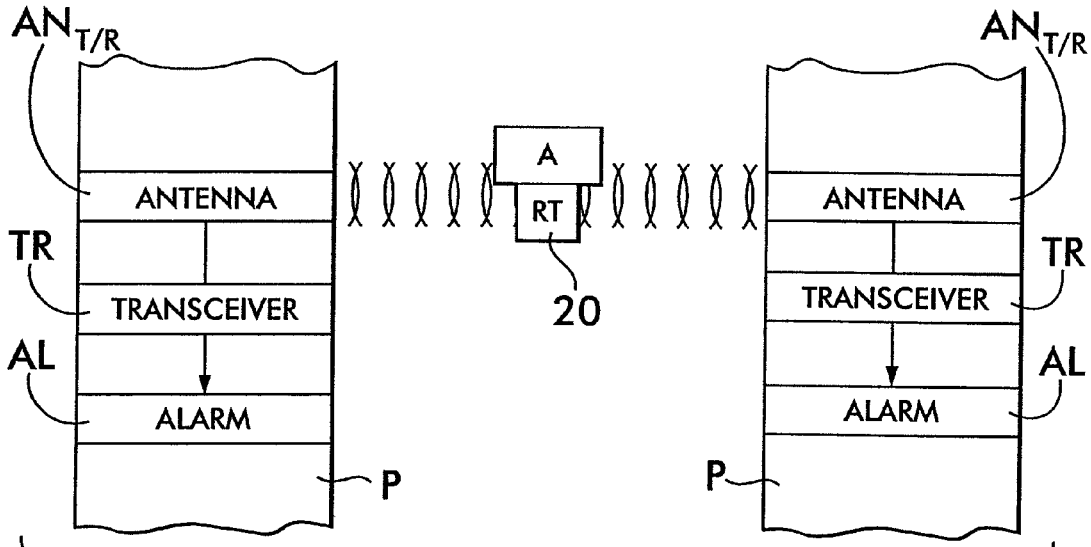
FIG.11B

WASH DESTRUCTIBLE RESONANT TAG

CROSS-REFERENCE TO RELATED APPLICATIONS

This application claims priority from Provisional Application Ser. No. 60/968,713, filed on Aug. 29, 2007, entitled Wash Destructible Resonant Tag, which application is assigned to the same assignee as this application and whose disclosure is incorporated by reference herein.

BACKGROUND OF THE INVENTION

1. Field of Invention

The present invention relates to a resonant tag used for the prevention of shoplifting or the like, and more particularly, to a resonant tag that can be made extremely thin for use on very small items while not compromising performance, and which is permanently deactivated when washed or dry cleaned along with a piece of clothing or other washable/dry cleanable article to which it is attached.

2. Description of Related Art

In retail shops, libraries or the like, a surveillance system including a resonant tag that resonates with a radio wave, a transmitting antenna and a receiving antenna has been used for the prevention of shoplifting. The resonant tag is composed of an insulating film, a coil and a plate made of a conductive metal foil formed on one side of the insulating film, and a plate made of a conductive metal foil formed on the other side, which constitute an LC circuit and resonates with a radio wave at a particular frequency. If an article with the resonant tag attached passes through a surveillance area without being checked out, the resonant tag resonates with the radio wave from the transmitting antenna, and the receiving antenna detects the resonance and generates an alarm. A typically used resonant frequency is 5 to 15 MHz, because frequencies within the range can be easily distinguished from various noise frequencies. In electronic article surveillance (EAS), a frequency of 8.2 MHz is most popularly used, and in radio frequency identification (RFID), a frequency of 13.56 MHz is most popularly used.

According to the prior art, even the smallest resonant tag has a significantly large size of 32 mm by 35 mm of rectangular shape and is difficult to attach to small cosmetics items, gems or the like. This is due to the fact that it has been impossible to produce a circuit that has a size meeting the market demand while maintaining the capability of resonating at a frequency of 5 to 15 MHz and maintaining a sufficient gain.

The inventors have previously developed a small tag that has a special configuration in which a coil is formed on each side of an insulating film (see Japanese Patent Laid-Open No. 2001-167366). However, this tag has a disadvantage in that the coil circuits formed on the opposite sides of the insulating film have to be precisely aligned with each other, so that the tag is difficult to manufacture. In addition, there is a problem that, since the metal-foil coils are formed on the both sides of the insulating film, the tag is thick, has a rough touch, is less flexible and is less suitable for handling by a hand labeler.

By way of example only, FIGS. 1-3 depict another prior art resonant tag 10 which includes a coil 11 and a first capacitor plate 12 on one side (FIG. 1) of a substrate 13 and a second capacitor plate 14 on the other side of the substrate 13 (FIG. 2). FIG. 3 is a cross-sectional view of this prior art tag showing a typical substrate thickness, t, of approximately 20 microns, which tends to be the thinnest dielectric that can be formed using conventional dielectric forming methods (e.g., extruding polyethylene between the metal layers). Adhesive layers 15 and 17 secure the metal layers to the substrate 13 respectively.

Prior art resonant tags formed as in FIGS. 1-3 are commonly deactivated, once an article with the resonant tag is purchased, by application of a predetermined voltage to a thinned part of the dielectric to cause dielectric breakdown, thereby making the resonant tag incapable of resonating with a radio wave at a predetermined frequency. A common problem with this type of deactivation means occurs where the tag is incorporated into or attached to an article of clothing. Often, the dielectric heals itself when the clothing is worn or washed. In tags having polyethylene dielectrics, as many as 50% of the tags become reactivated with wearing or laundering. This unintended reactivation has undesirable consequences for the wearer of the clothing, who will activate security tag detection devices when exiting any store with equipment tuned to the tag's resonant frequency. Not only is the false alarm inconvenient and embarrassing for the person wearing the clothing with the reactivated tag, but frequent false alarms can cause a "boy who cried wolf" effect. Store personnel can become lax about enforcement of tag alarms when many of them are falsely triggered by reactivated tags on legitimately purchased goods. Clothing brands bearing re-activatable tags may so irritate consumers that sales are lost. Clearly, a need exists for a security tag for clothing that does not re-activate when washed.

All references cited herein are incorporated herein by reference in their entireties.

BRIEF SUMMARY OF THE INVENTION

An object of the present invention is to provide a resonant tag mainly used in a radio-wave detection system for the prevention of shoplifting or the like that has a coil circuit formed on only one side, has reduced size and improved performance, and which is permanently disabled by conventional laundering or dry cleaning of clothing or other articles associated with the tag.

As a result of earnest study, the inventors have found that the object described above can be attained if an extremely thin polypropylene film is used as an insulating film, the insulating film and metal foils are laminated using particular adhesives, and the device has outer paper layers affixed to each surface with particular adhesives, and achieved the present invention.

Briefly, the present invention is as follows. A resonant tag resonates with a radio wave at a predetermined frequency and comprises: a polypropylene film (e.g., a biaxially-oriented polypropylene film) having a thickness of approximately 8 μm or less; a first circuit comprising a first metal foil (e.g., aluminum) including a coil portion and a plate portion, which comprises a first plate of a capacitor, formed on one side of the polypropylene film; a second circuit made of a second metal foil (e.g., aluminum) including a plate section which comprises a second plate of the capacitor, formed on the other side of the polypropylene film; and an outer paper layer adhered to each side of the resonant tag, wherein both circuits comprise an LC circuit by being electrically connected and wherein the metal foils and the polypropylene film are laminated to each other.

The resonant tag as described previously, wherein the metal foils and polypropylene film are laminated to each other by a styrene-based or olefin-based adhesive.

The resonant tag as described previously wherein the resonant tag has an area of approximately 750 $mm^2$ or less.

The resonant tag as described previously in which the predetermined resonant frequency is approximately 5 to 15 MHz.

A method for producing a resonant tag that resonates with a radio wave at a predetermined frequency (e.g., approximately 5 to 15 MHz), comprising: providing a polypropylene film (e.g., a biaxially-oriented polypropylene film) having a thickness of approximately 8 μm or less; applying a first adhesive (e.g., a styrene-based or olefin-based adhesive) to one side of the polypropylene film; applying a first metal foil (e.g., aluminum) to the first adhesive; applying a second adhesive (e.g., a styrene-based or olefin-based adhesive) to the other side of the polypropylene film; applying a second metal foil (e.g., aluminum) to the second adhesive to form a laminate; feeding the laminate to an etching process to remove portions of the first and second foils to form an LC circuit; and laminating a paper layer to each side of the tag with a third adhesive (acrylic).

A method for producing a resonant tag that resonates with a radio wave at a predetermined frequency(e.g., approximately 5 to 15 MHz), comprising: providing a polypropylene film (e.g., a biaxially-oriented polypropylene film) having a thickness of approximately 8 μm or less; applying a first adhesive (e.g., a styrene-based or olefin-based adhesive) to one side of a first metal foil (e.g., aluminum); applying a second adhesive (e.g., a styrene-based or olefin-based adhesive) to one side of a second metal foil (e.g., aluminum); applying the first metal foil with the first adhesive and the second metal foil with the second adhesive to respective sides of a polypropylene film to form a laminate; feeding the laminate to an etching process to remove portions of the first and second foils to form an LC circuit and laminating a paper layer to each side of the tag with a third adhesive (e.g., acrylic).

The resonant tag according to the present invention achieves high performance, although the resonant tag has a coil only on one side thereof If the tag has the same size as the conventional tag, the tag achieves higher performance than the conventional one. If the tag achieves the same performance as the conventional tag, the tag has a smaller size than the conventional one. For example, the tag according to the present invention having a size of 34 mm by 36 mm can achieve substantially the same performance as a conventional tag having a size of 40 mm by 40 mm. Even if the size is equal to or less than 750 $mm^2$, the tag according to the present invention resonates at a frequency of 5 to 15 MHz and has a sufficient gain. Since the coil is formed only on one side of the dielectric film, the manufacture is less difficult, a practically sufficient tolerance of alignment of the print patterns on the opposite sides is ensured, and a printing method having a sufficient productive capacity can be used. Astonishingly, the variation of the resonant frequency is extremely small. In addition, the tag is characterized also by a high gain per unit area. The present invention can provide such a high-performance small tag. In particular, the present invention can provide a resonant tag having a rectangular outer shape (including square) and a size of 25 mm by 28 mm or smaller, and furthermore, a resonant tag having a size of 23 mm by 26 mm or smaller. Of course, the present invention can provide a larger resonant tag. In addition, the thickness of the tag can be reduced compared with conventional ones. Furthermore, the present invention can provide a narrow elongated resonant tag, which has been difficult to realize in terms of performance, and thus has a wider variety of commercial applications, such as cosmetic items. The present invention is also permanently deactivated when washed in a conventional water-based process or in a dry cleaning process. In addition, the present invention can be manufactured on a web process with the polypropylene as the carrier, wherein the web width is wider than previously possible with tags constructed by prior art processes.

BRIEF DESCRIPTION OF SEVERAL VIEWS OF THE DRAWINGS

The invention will be described in conjunction with the following drawings in which like reference numerals designate like elements and wherein:

FIG. 3 is a cross-sectional view of the prior art resonant tag taken along line 3-3 of FIG. 1;

FIG. 4 is an enlarged plan view of a resonant tag according to the present invention, prior to the application of outer paper layers, with the capacitor plate on the other, or second, side of the substrate being shown in phantom;

FIG. 5 is an enlarged plan view of the first side of the resonant tag of the present invention;

FIG. 10 is an enlarged view of the capacitor plates showing the thin sections in each plate of the present invention;

FIG. 11A is a block diagram of a resonant tag detection system using a discrete transmitter and receiver;

FIG. 11B is a block diagram of a resonant tag detection system using transceivers;

DETAILED DESCRIPTION OF THE INVENTION

Figure 12:
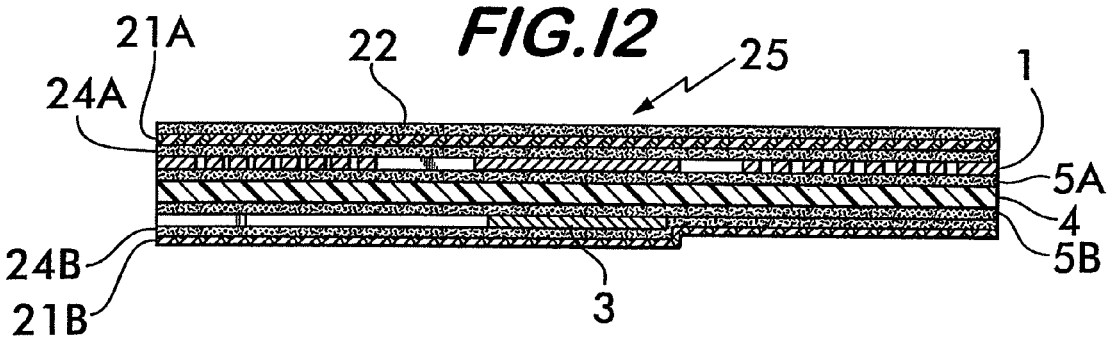
FIG. 12 is a cross-sectional view of a resonant tag with outer paper layers.

As shown in FIGS. 4-7, the resonant tag 20 according to the present invention has a circuit composed of a coil portion 1 and one of the plate portion 2 of a capacitor on one side and a circuit composed of the other plate portion 3 of the capacitor on the other side. The two circuits constitute an LC circuit by being electrically connected such that the plate portion 2 is electrically connected to one end of the coil portion 1 and wherein the other end of the coil portion 1 is electrically connected to the other plate 3. The plate portions preferably have a thin part (10A and 10B, see FIG. 10) that has a thinner insulating film than the other parts so that dielectric breakdown occurs when a voltage is applied thereto. As shown in FIG. 12, the resonant tag 20 also has paper outer layers 21A and 21B adhered to each of the foil portions, 1/2 and 3 with an adhesive 24A and 24B, respectively. Once an article with the resonant tag is purchased, a predetermined voltage is applied to the thin part (10A, 10B) to cause dielectric breakdown, thereby making the resonant tag incapable of resonating with a radio wave at a predetermined frequency. Where the tag is attached to or inserted in an article of clothing, or other washable article the tag is permanently disabled when the clothing is washed.

An insulating film 4 (FIG. 7) used in the present invention is made of polypropylene, and preferably, a biaxially oriented polypropylene. The insulating film 4 has a thickness, $t_F$, of 8 μm or less, and preferably, 5 μm or less. If the thickness is greater than 8 μm, a small resonant tag with a required performance cannot be designed.

The coil portion 1 and plate portion 2, as well as the plate portion 3, are formed from a metal foil such as copper foil or aluminum foil; aluminum foil preferred. The metal foil typically has a thickness of 30 to 120 μm, and preferably, 50 to 80 μm.

An adhesive (5A and 5B, see FIG. 7) is used for bonding the metal foil and the polypropylene insulating film 4. Styrene-based or olefin-based adhesives are preferable. Styrene-based adhesives include styrene-butadiene resin and styrene-isoprene resin, and styrene-butadiene resin is more preferable. Alternatively, these resins modified with acrylic acid, butyl acrylate, maleic acid or the like may be used. Olefin-based adhesives include olefin-based resins, such as polypropylene, and modified-olefin-based resins, such as modified polypropylene, and modified polypropylene is more preferable. As modified resins, such resins as modified with acrylic acid, butyl acrylate, maleic acid or the like are exemplified. Such resins may be either the solvent type or dispersion type. However, in terms of drying rate, the solvent type is more preferable.

The adhesive layer (5A and 5B) preferably has a thickness of 1 μm or less, and more preferably has a thickness of 0.7 μm or less. As the thickness of the adhesive layer (5A and 5B) decreases, the performance of the resonant tag 20 is improved.

Thus, by using the extremely thin insulating film 4 and then the thin adhesive layers 5A and 5B, the overall performance of the resonant tag 20 can be improved. This can be appreciated from the definition of capacitance:

$$C = \frac{kA}{d}$$

Where C is the capacitance, A is the area of each plate, d is the distance between them (effectively, the thickness, $t_F$, of the insulating film 4) and k is the permittivity constant. Thus, by using an insulating film 4 of 8 μm or less, the size of the capacitor plates 2 and 3 can be reduced, while providing the same performance that a capacitor with a thicker dielectric and larger capacitor plates would provide. Furthermore, by reducing the size of the capacitor plates 2 and 3, more flux can pass through the center of the coil 1, thereby increasing the resonant tag performance.

The resonant tag 20 according to the present invention is fabricated as described below.

Figure 9A:
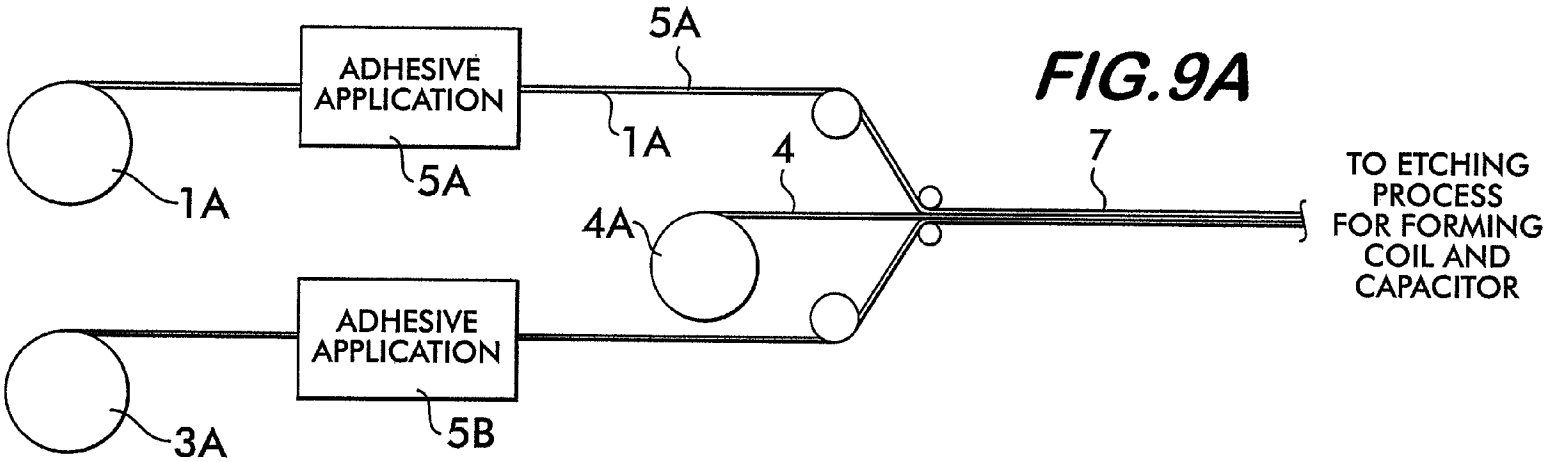
FIG. 9A is a diagram of a formation process for the inside layers of the present invention.

The adhesive 5A and 5B are applied to one side of each of two metal foils 1A and 3A, respectively, by roll coating, and the metal foils 1A and 3A are laminated on the both sides of the polypropylene film 4 having a thickness of 8 μm or less. This can be seen in FIG. 9A where the rolls of metal foils 1A (which ultimately form the coil 1/first capacitor plate 2) and 3A (which ultimately forms the second capacitor plate 3 and associated conductor) are laminated to the film 4. Once the respective adhesives 5A/5B are applied, they are laminated to the insulating film 4 from a roll of insulating film 4, forming a laminate film 7. Typically, dry lamination is adopted in which lamination is carried out after the applied adhesive has dried. In conventional methods of manufacturing resonant tags, typically, lamination of the metal foils is achieved by extrusion lamination of polyethylene. However, such conventional methods have a problem that the thickness of the polyethylene film can be reduced only to a certain degree, and the thickness varies, which imposes a limit on the performance of the resonant tag. According to the present invention, this problem with the prior art is solved by previously fabricating a polypropylene film having a specific thickness by a well-known method and laminating metal foils with a specific adhesive on the sides of the polypropylene film. The polypropylene film has the additional benefit in that, when used in a web manufacturing process, the film can serve as the web support and allows web process widths that are substantially wider than possible in the prior art.

Figure 9B:
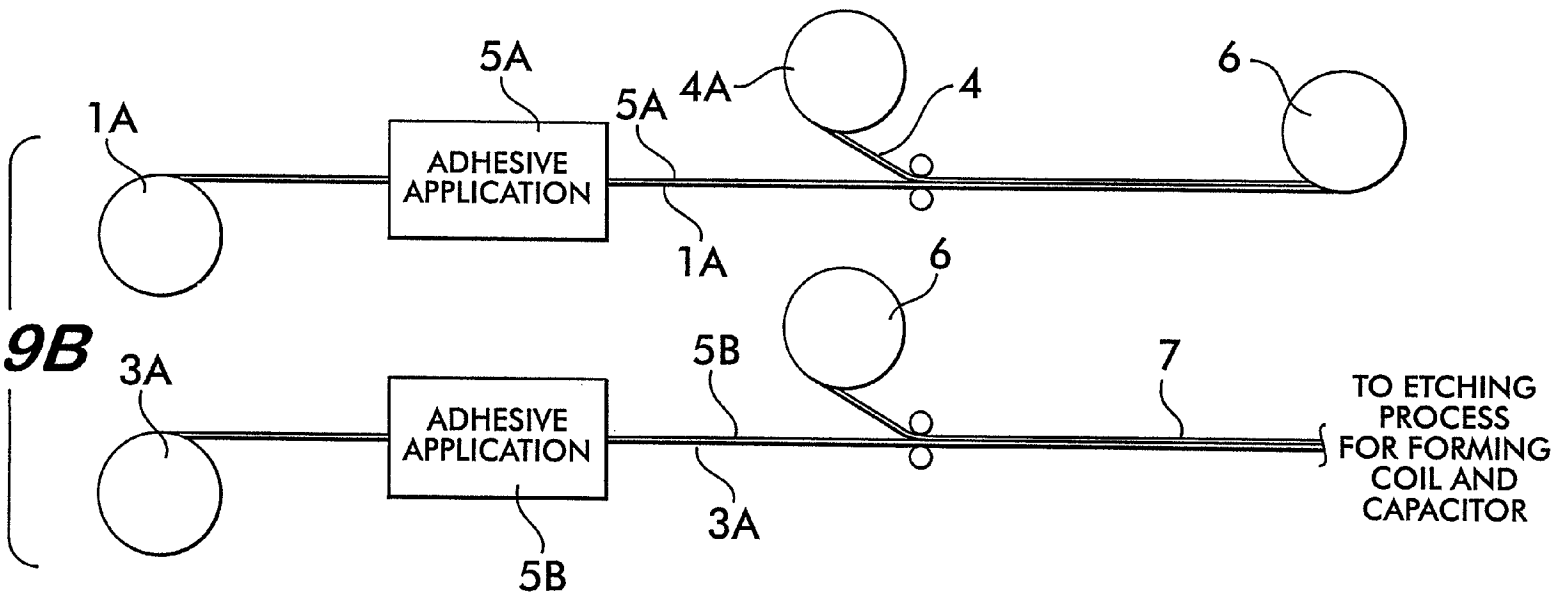
FIG. 9B is a diagram of an alternative formation process for the inside layers of the present invention.

An alternative formation process for the film and metal layers is shown in FIG. 9B. In this process, the adhesive 5A is applied to the metal foil 1A and then laminated to one side of the insulating film 4 and captured on a roll 6. Next, the adhesive 5B is applied to the metal foil 3A and then laminated on the other side of the insulating film 4, forming the laminate film 7.

In both the metal foils 1A and 3A of the resulting laminate film 7, a desired pattern is drawn using an etching resist. Typically, a pattern including a coil portion 1 and a plate portion 2 is drawn on one side, and a pattern including a plate portion 3 is drawn on the other side. Printing of the etching resist can be achieved by screen printing, rotary letterpress printing, flexography, offset printing, photolithography, gravure printing or the like. The printed etching resist is etched to form metal-foil circuits on the two sides.

Preferably, then, a thin part (10A and 10B, see FIG. 10) is formed in the plate portion 2 and 3, respectively.

Figure 15:
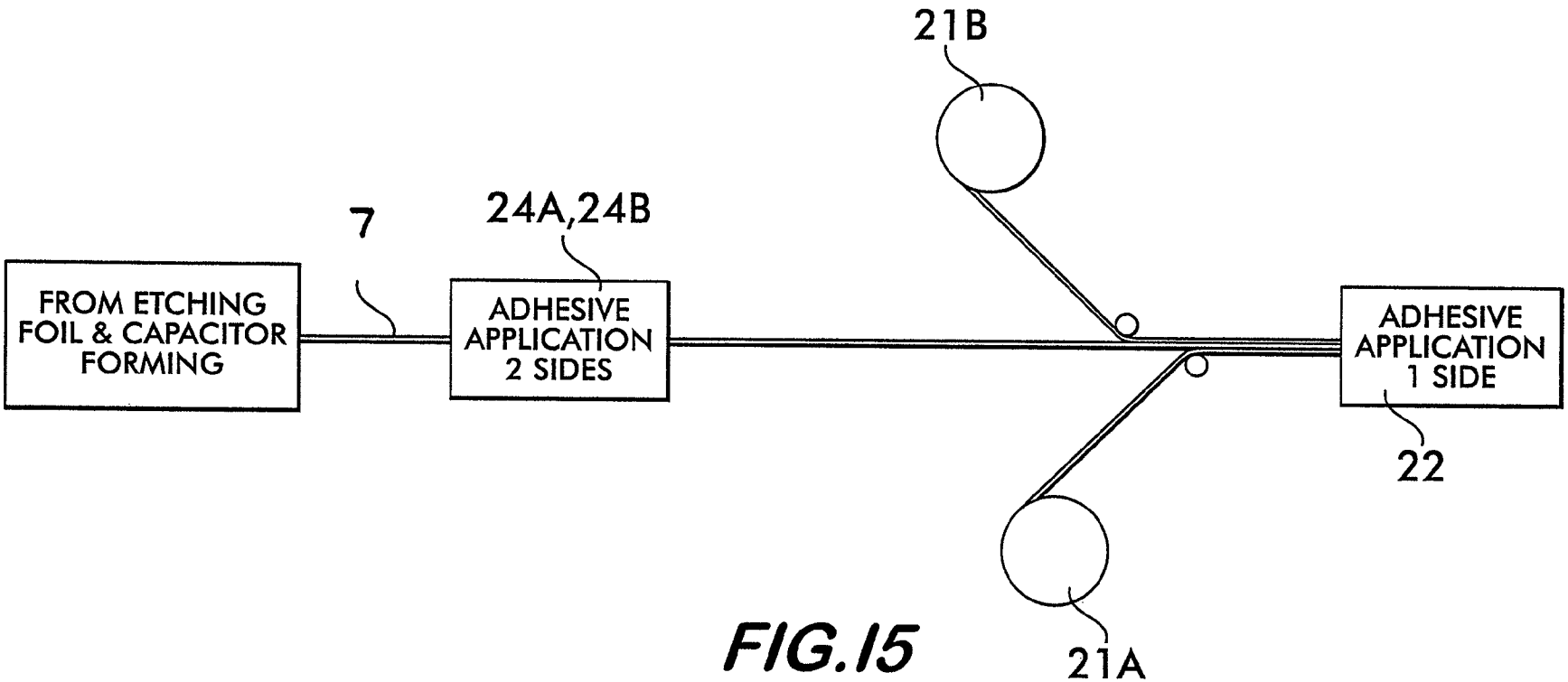
FIG. 15 is a diagram of a formation process of the present invention.

Once the film and metal layers are formed, for example, as described above and in FIGS. 9A and 9B, paper layers 21A and 21B are added. An exemplary process for adding the paper layers is shown in FIG. 15. Laminate film which has had the metal layers formed as described below, enters an adhesive application stage, where adhesive is applied to both sides. In a typical embodiment, the adhesive is an acrylic adhesive such as emulsion based acrylic adhesive. The tags on the laminate film are then sandwiched between upper and lower paper layers, 21A and 21B, which, in a continuous process, are supplied in roll form. If the completed tag is to have adhesive on one side of the outer paper layer, this outer adhesive 22 is applied after the two paper layers are adhered to the tag. If the tag will not be directly adhered to the product it is to protect as part of the manufacturing process, then the outer layer of adhesive 22 is a pressure sensitive adhesive and the tag 20 is faced with release paper, which is later removed when the tag is affixed to a garment or the like. In an exemplary embodiment, the release paper is litho paper of 100 microns or less thickness. Adhesives include thermoplastic adhesives such as emulsion acrylic, PVOH (polyvinyl alcohol) and PVAc (Polyvinyl acetate). In another embodiment, the tag is adhered directly to a fabric for inclusion in a garment.

In the resonant tag 20 according to the present invention, there is formed an LC circuit that resonates with a radio wave at a predetermined, desired frequency. To this end, not only the thickness of the polyolefin thin film described above and the thickness of the adhesive layer are determined, but also the thickness of the metal foils, the number of windings of the coils, the distance between the coils, the area of the plates and the like are appropriately determined. As described above, the most commonly used resonant frequency is 8.2 MHz for EAS and 13.56 MHz for RFID. In addition, if the article to which the tag is attached has an intrinsic capacitance, the frequency characteristics of the tag are determined so that interaction between the article and the tag provides a predetermined resonant frequency. For example, meat is such an article.

The resonant tag 20 according to the present invention is attached to an article A, (see FIGS. 11A and 11B) for use. If an article with the resonant tag 20 having not been subjected to dielectric breakdown passes between a pair of antennas for transmission and reception of a radio wave at a predetermined frequency installed at an exit of a shop or the like, the resonant tag 20 resonates with the radio wave transmitted from a transmitter section, and a receiver section detects the resulting resonant radio wave and generates an alarm AL. Transmission and reception of the radio wave may be achieved by different ones of the right-side and left-side antennas. Alternatively, each antenna maybe capable of both transmission and reception of the radio wave. In the case where transmission and reception are achieved by different antennas ($AN_T$ and $AN_R$, see FIG. 11A) from a transmitter T and receiver R (in respective pedestals, P), if the article A passing between the antennas is distant from the transmitting antenna $AN_T$, that is, closer to the receiving antenna $AN_R$, the sensitivity may decrease. In the case where each of the pair of antennas is capable of both transmission and reception ($AN_{T/R}$ see FIG. 11B) since they are coupled to transceivers T/R, the maximum distance between the article and the transmitter section is half of the distance between the antennas, and thus, the sensitivity is high compared with the former case. In this case, each antenna alternately performs transmission and reception at an extremely short cycle.

Figure 13:
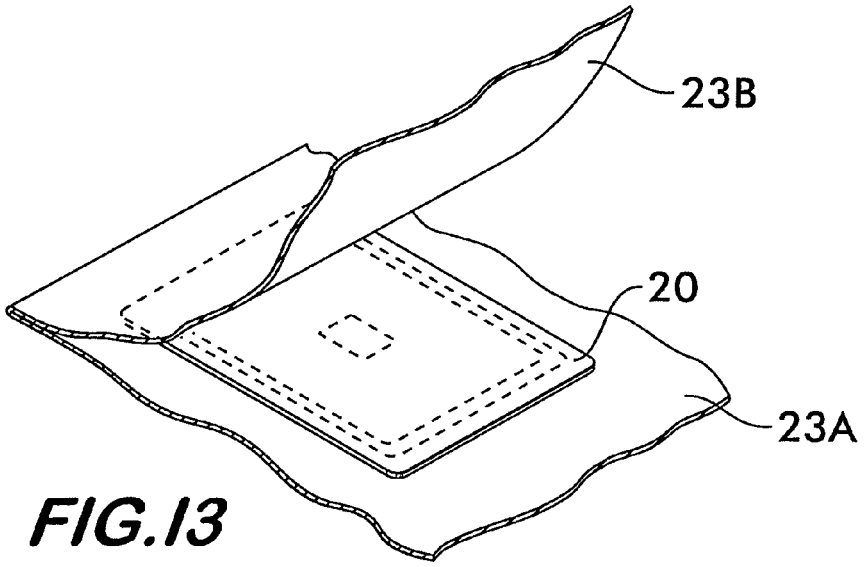
FIG. 13 shows a resonant tag installed in a fabric carrier.
Figure 14:
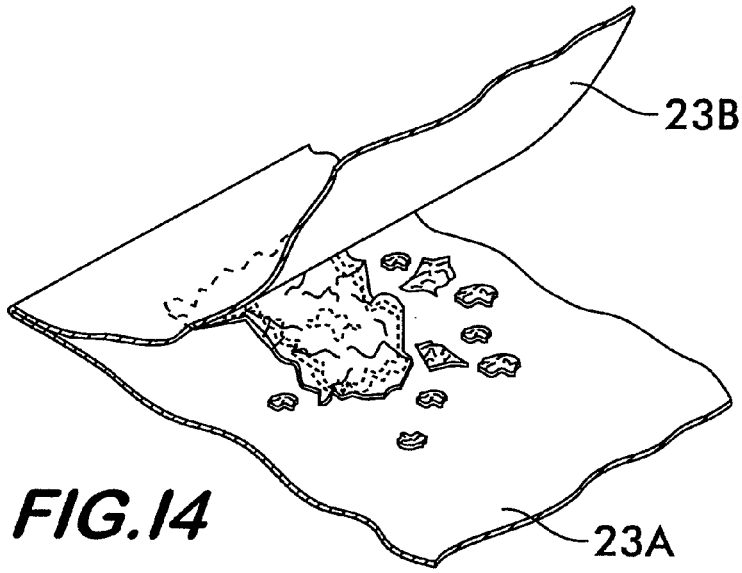
FIG. 14 shows the condition of a resonant tag after washing.

In an embodiment for use with an article of clothing or other articles made of fabric, such as bedding, draperies, camping equipment and the like, the tag 20 is embedded in a fabric pouch 23A and 23B as shown in FIG. 13. In an embodiment, the tag 20 has an adhesive layer 22 on an outer surface and is adhered to fabric 23A. The tag is then sewn or otherwise entrapped between fabric layers 23B and 23A. The pouch 23A, 23B and tag 20 are the sewn to or otherwise affixed or placed within an article of merchandise. Where the article is such that it can be washed, the tag 20 is exposed to the washing fluids through the fabric 23A, 23B. In the washing process, the paper layers 21A, 21B are saturated with the washing fluid and the paper, metal and dielectric layers become distorted and crumble into lumps and smaller pieces, as shown in FIG. 14. In a normal washing cycle, the distortion of the paper and the underlying metal foil is significant and the tag is destroyed and the foil folded to the point that it will no longer operate as a resonant circuit. Thus, the problem with prior art tags reactivating when washed is remedied, since the very process that causes reactivation destroys the tag to the point that it will not resonate. Experimentation has shown that tags constructed as disclosed are destroyed by both water-based washing and dry cleaning.

PRACTICAL EXAMPLES

In the following, examples of the present invention will be described. However, the present invention is not limited to the examples in any sense. Here, evaluation of resonant tags was made as described below.

Figure 1:
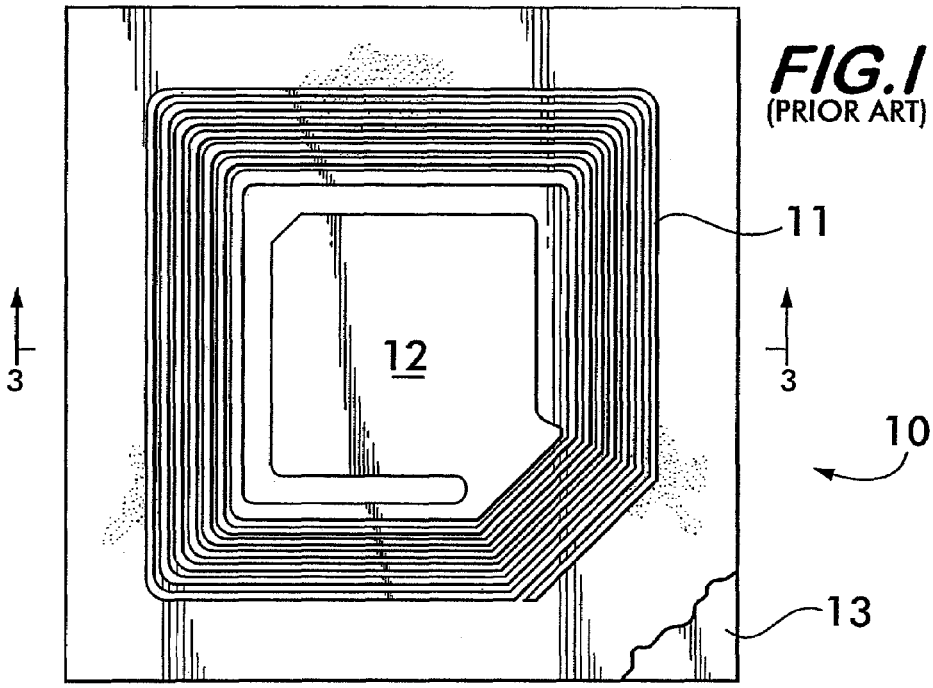
FIG.1 (PRIOR ART)
FIG. 1 is an enlarged plan view of one side of a prior art resonant tag.
Figure 2:
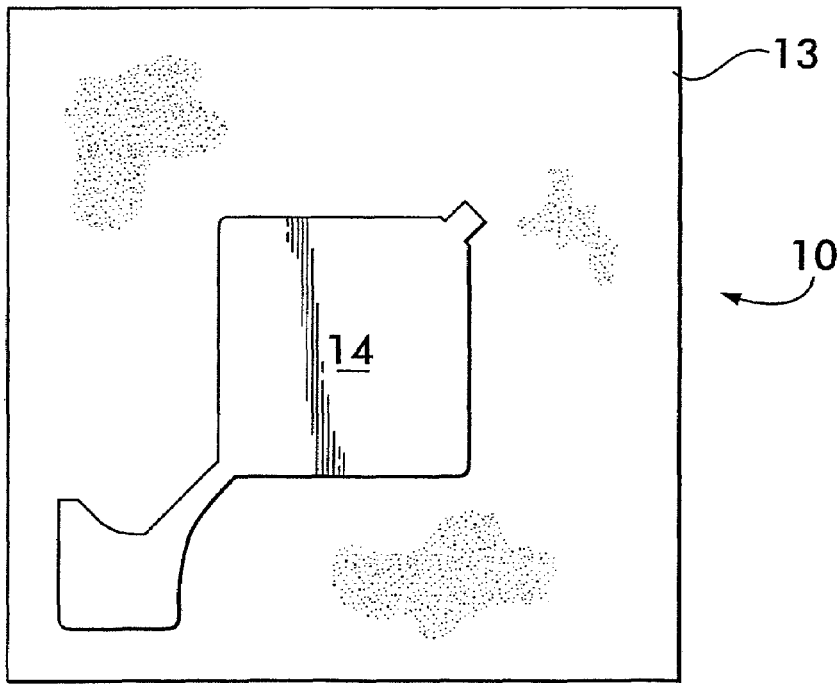
FIG.2 (PRIOR ART)
FIG. 2 is an enlarged plan view of the other side of the prior art resonant tag of FIG. 1.
Figure 6:
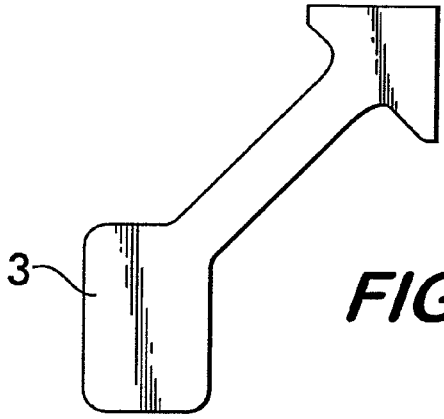
FIG. 6 shows an enlarged view of the capacitor plate and associated conductor for use on the second side of the substrate of the resonant tag of the present invention.
Figure 7:
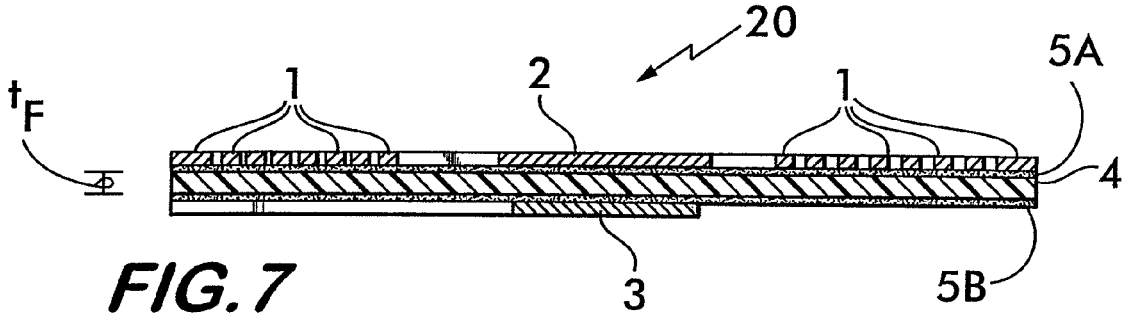
FIG. 7 is a cross-sectional view of the resonant tag of the present invention taken along line 7-7 of FIG. 4, prior to the application of outer paper layers.
Figure 8:
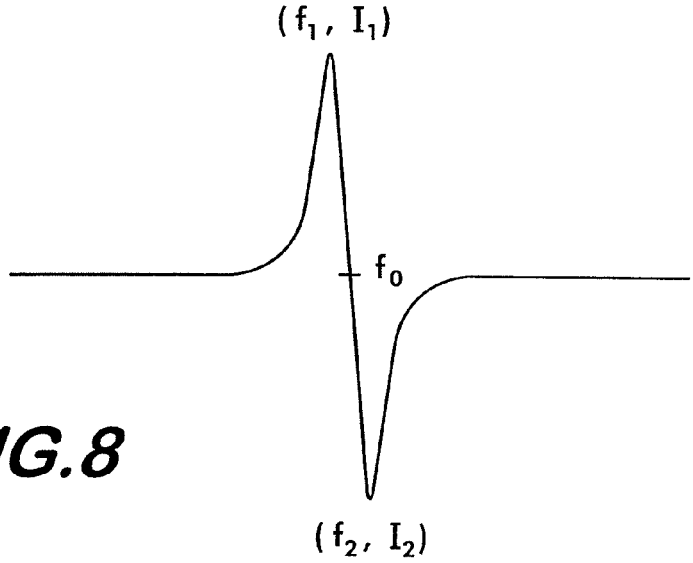
FIG. 8 shows a resonant curve measured using a network analyzer.

The frequency, the Q value and the amplitude (Amp (dB)) are measured using a network analyzer with a measuring coil composed of a transmitter and a receiver connected thereto. Once a resonant tag 20 is placed at the center of the measuring coil, a resonant curve is displayed on a monitor in which the horizontal axis indicates the frequency, and the vertical axis indicates the amplitude (Amp (dB)), as shown in FIG. 8. The frequency ($f_o$) of the tag is represented by the central value of the amplitude. The amplitude (Amp (dB)) indicates the intensity of the signal emitted from the tag, 20 which is represented as the magnitude of the amplitude ($I_1$-$I_2$) or signal density which is referred to as GST. GST is a voltage value (volt) produced by a multimeter from the intensity of the signal received at the receiver. The Q value indicates the steepness of the amplitude, which is represented by $f_o$/half-width ($f_1$-$f_2$). In order to be commercially useful and detectable at a reasonable range, the Q value of the tag has to be at least 50 or higher, and is preferably 55 or higher.

Practical Example 1, Comparison Example 1

To one side of each of an aluminum foil having a thickness of 80 μm and an aluminum foil having a thickness of 9 μm, 1 g/m$^2$ (in dry weight) of a styrene-butadiene-based adhesive was applied by roll coating and dried, and the aluminum foils were laminated to either sides of a biaxially oriented polypropylene film having a thickness of 5 μm by dry lamination. By gravure printing or the like, an etching resist was applied to the 80-μm aluminum foil of the resulting laminate film in the pattern shown in FIG. 5 and was applied to the 9-μm aluminum foil in the pattern shown in FIG. 6. Then, etching was accomplished using ferric chloride or hydrochloric acid, thereby forming the circuits. In this way, a tag having a size of 27 mm by 30 mm (an area of 810 mm$^2$) was fabricated.

For comparison, a tag was fabricated in the same manner as in the example 1 except that a urethane-based adhesive was used.

Evaluation results of these tags are shown in Table 1. In practical example 1 in which the styrene-butadiene-based adhesive is used, the Q value, the Amp and the GST are all sufficiently high, and the tag can offer sufficient performance. However, in the comparison example 1 in which the urethane-based adhesive is used, the tag is inferior to that of the practical example 1 in all of the three items and cannot offer sufficient performance.

TABLE 1

| | RF (MHz) | Q value | Amp (dB) | GST |
|---|---|---|---|---|
| comparison example 1 | 8.559 | 42.64 | 0.741 | 0.282 |
| practical example 1 | 8.428 | 61.06 | 1.003 | 0.400 |

Practical Examples 2 to 4

Tags having a size of 25 mm by 28 mm (an area of 700 mm$^2$) were fabricated in the same manner as in practical example 1 except that the amount of the applied styrene-butadiene-based adhesive was varied, and evaluation of the tags was made. For each tag, however, an equal amount of adhesive was applied to both the aluminum foils (designated in the table as Al 80 μm and Al 9 μm). The evaluation result is shown in Table 2.

TABLE 2

| | amount of adhesive applied A1 80 μm/A1 9 μm | RF (MHz) | Q value |
|---|---|---|---|
| practical example 2 | 0.6 g/0.6 g | 9.684 | 66.153 |
| practical example 3 | 1.0 g/1.0 g | 9.911 | 64.383 |
| practical example 4 | 1.6 g/1.6 g | 10.633 | 61.706 |

Practical Example 5, and Comparison Example 2

To one side of each of two aluminum foils having a thickness of 50 μm, 1 g/m$^2$ (in dry weight) of a modified polypropylene adhesive was applied by roll coating and dried, and the aluminum foils were laminated to either sides of a biaxially oriented polypropylene film having a thickness of 5 μm by dry lamination. Then, in the same manner as in the practical example 1, a tag having a size of 27 mm by 30 mm (an area of 810 mm$^2$) was fabricated.

For comparison, a tag was fabricated in the same manner as in the practical example 5 except that a urethane-based adhesive was used. The evaluation result is shown in Table 3.

TABLE 3

| | RF (MHz) | Q value | Amp (dB) | GST |
|---|---|---|---|---|
| comparison example 2 | 7.625 | 42.00 | 0.586 | 0.229 |
| practical example 5 | 7.620 | 52.20 | 0.743 | 0.283 |

Practical Example 6

0.54 g/m$^2$ of a modified polypropylene adhesive was applied to one side of an aluminum foil having a thickness of 80 μm by roll coating and dried, 0.59 g/m$^2$ of a styrene-butadiene-based adhesive was applied to one side of an aluminum foil having a thickness of 9 μm by roll coating and dried, and the aluminum foils were laminated to either sides of a biaxially oriented polypropylene film having a thickness of 5 μm by dry lamination. Then, in the same manner as in the practical example 1, a tag having a size of 25 mm by 28 mm (an area of 700 mm$^2$) was fabricated. The evaluation result is shown in Table 4.

TABLE 4

| | RF (MHz) | Q value | Amp | GST |
|---|---|---|---|---|
| practical example 6 | 8.924 | 56.52 | 0.787 | 0.300 |

The resonant tag according to the present invention is small and flexible and has a reduced total thickness. This invention allows for smaller capacitor area and creates new performance in smaller sizes. Therefore, the tag can be suitably used in a detection system for the prevention of shoplifting of small articles, for example. In addition, the tag is highly suitable for a hand labeler.

It should be further noted that an alternative aspect of coupling of the resonant tag with the article A may also provide a method for influencing the predetermined resonant frequency. For example, an initial frequency of the resonant tag maybe determined so that, when the resonant tag is attached to an article A, interaction with an intrinsic capacitance of the article A allows the resonant tag to resonate at the predetermined resonant frequency.

It should be further noted that while tag fabrication on a web process is described herein as an example, other methods of manufacture are possible that would use materials of the same or similar dimensions as described herein.

While the invention has been described in detail and with reference to specific examples thereof, it will be apparent to one skilled in the art that various changes and modifications can be made therein without departing from the spirit and scope thereof.

What is claimed is:

1. A resonant tag and carrier, the tag resonating with a radio wave at a predetermined frequency, the tag comprising:

a polypropylene film having a thickness of approximately 8 μm or less;

a first circuit comprising a first metal foil including a coil portion and a plate portion, which comprises a first plate of a capacitor, formed on one side of said polypropylene film;

a second circuit made of a second metal foil including a plate section which comprises a second plate of said capacitor, formed on the other side of said polypropylene film;

a first paper layer adhered to said first circuit side;

a second paper layer adhered to said second circuit side; and wherein said both circuits comprise an LC circuit by being electrically connected;

the carrier comprising a fluid-permeable fabric;

wherein the tag is enclosed in the carrier such that when the carrier and tag are immersed in water, said paper layers are saturated with said fluid.

2. The resonant tag of claim 1 wherein said polypropylene film comprises a biaxially oriented polypropylene film.

3. The resonant tag according to claim 2, wherein said resonant tag has an area of 750 mm$^2$ or less.

4. The resonant tag of claims 2 wherein the predetermined resonant frequency is 5 to 15 MHz.

5. The resonant tag of claim 1 wherein said first and second metal foils comprise aluminum.

6. The resonant tag of claim 1 wherein said metal foils and said polypropylene film are laminated to each other by a styrene-based or olefin-based adhesive.

7. The resonant tag of claim 1 wherein said paper layers are adhered to said first and second circuit sides with a water-based adhesive.

8. The resonant tag and carrier of claim 1, wherein said fluid is water or dry-cleaning fluid.

9. A method for deactivating a resonant tag that resonates with a radio wave at a predetermined frequency, comprising:

forming the tag having:

a polypropylene film having a thickness of approximately 8 μm or less;

a first circuit comprising a first metal foil including a coil portion and a plate portion, which comprises a first plate of a capacitor, formed on one side of said polypropylene film;

a second circuit made of a second metal foil including a plate section which comprises a second plate of said capacitor, formed on the other side of said polypropylene film;

a first paper layer adhered to said first circuit side;

a second paper layer adhered to said second circuit side;

wherein said both circuits comprise an LC circuit by being electrically connected; and immersing said tag in a washing fluid in a washing cycle;

saturating said paper sheets in said washing fluid;

wherein said metal foil and film are distorted, rendering the tag deactivated.

10. The method of claim 9 wherein said first and second adhesives comprise a styrene-based or olefin-based adhesive.

11. The method of claim 9 wherein said polypropylene film comprises a biaxially-oriented polypropylene film.

12. The method of claim 9 wherein said resonant tag has an area of 750 $mm^2$ or less.

13. The method of claim 9 wherein the predetermined resonant frequency is 5 to 15 MHz.

14. The method of claim 9 wherein said first and second metal foils comprise aluminum.

15. The method of claim 9 wherein said paper sheets are adhered to said first and second foil sides with a water-based adhesive.

16. The method of claim 9, wherein said washing fluid is water or dry-cleaning fluid.

17. A method for deactivating a resonant tag comprising, forming a resonant tag having a polypropylene film having a thickness of approximately 8 μm or less, a metal foil layer and a one paper layer;

immersing said tag in a washing fluid in a washing cycle;

saturating said paper layer in said washing fluid;

wherein said metal foil is distorted, rendering the tag deactivated.

18. The method of claim 17, wherein said washing fluid is water or dry-cleaning fluid.

* * * * *